US005687515A

United States Patent [19]

Rodrigues et al.

[11] Patent Number: 5,687,515

[45] Date of Patent: Nov. 18, 1997

[54] MONUMENT DISPLAY CASE AND MOUNTING ASSEMBLY

[76] Inventors: Robert Wallace Rodrigues, 325 W. Maple Ave., Bound Brook, N.J. 08805; Wallace Joseph Rodrigues, 125 S. 17th Ave., Manville, N.J. 08835

[21] Appl. No.: 701,022

[22] Filed: Aug. 21, 1996

Related U.S. Application Data

[63] Continuation-in-part of Ser. No. 490,565, Jun. 15, 1995, abandoned.

[51] Int. Cl.[6] ..... E04H 13/00

[52] U.S. Cl. ..... 52/103; 40/124.5

[58] Field of Search ..... 52/103; 40/124.5, 40/661, 800

[56] References Cited

U.S. PATENT DOCUMENTS

| | | | |
|---|---|---|---|
| 552,128 | 12/1895 | Hudson et al. | 40/124.5 |
| 1,982,432 | 11/1934 | Hull | 52/103 |
| 2,120,082 | 6/1938 | Anderson | 52/103 |
| 2,188,419 | 1/1940 | Saviteer | 52/103 |
| 2,255,277 | 9/1941 | Bronson | 52/103 |
| 2,525,091 | 10/1950 | Brownawell | 52/103 |
| 3,310,918 | 3/1967 | Taylor, Jr. | 52/103 |
| 4,175,363 | 11/1979 | Moskowitz | 52/103 X |
| 4,202,144 | 5/1980 | Patterson | 52/103 |
| 4,285,149 | 8/1981 | Berryhill | 40/124.5 |
| 4,304,076 | 12/1981 | Splendora | 40/124.5 X |
| 4,455,772 | 6/1984 | Miller | 40/124.5 |
| 4,790,088 | 12/1988 | Morvant | 40/124.5 |
| 5,014,472 | 5/1991 | Svensson | 52/103 |
| 5,230,172 | 7/1993 | Hsu | 40/661 X |
| 5,517,791 | 5/1996 | Weiss | 52/103 |
| 5,553,426 | 9/1996 | Ostergaard | 40/124.5 X |

*Primary Examiner*—Carl D. Friedman
*Assistant Examiner*—Beth Aubrey
*Attorney, Agent, or Firm*—Thomas R. Farino, Jr.

[57] ABSTRACT

The preferred embodiment of the invention disclosed herein relates to a display case for use in conjunction with headstones/monuments situated in a cemetery or other place of commemoration and an assembly for detachably mounting the display case to the upper portion of the headstone or monument. The display case extends above the top of the headstone and includes a front and back panel, two opposite side panels, a bottom panel and a sloped roof the joinder of which defines the display area. The interior of the case may contain one or more removable rigid shelves for display of the contents. The rear panel is hinged so as to operate as an access panel to the interior chamber and may contain a locking mechanism to protect the contents therein. The mounting assembly includes a series of front and rear face plates detachably mounted to the top portion of the headstone/monument by swivel bolts and firmly attached to the display case by threaded bolts.

9 Claims, 3 Drawing Sheets

MONUMENT DISPLAY CASE AND MOUNTING ASSEMBLY

This application is a continuation-in-part of U.S. patent application No. 08/490,565 filed on Jun. 15, 1995, now abandoned.

BACKGROUND OF THE INVENTION

This invention relates to headstones/monuments of the type intended to be anchored upright in or on a foundation.

The placement of various items at gravesites such as flowers, jewelry, photos and other mementos has long existed as a means of "keeping in touch" with the faithfully departed. These items are usually placed on the ground adjacent to the headstone and as such, create cemetery maintenance problems especially in the area of grass cutting. Additionally, many cemeteries have rules and regulations which prohibit the placement of such items on or about headstones and other grave markers.

SUMMARY OF THE INVENTION

It is apparent from the above that some form of display case which could be detachably mounted to an existing headstone or monument by means of an appropriate mounting assembly would be ideal in affording heirs the opportunity to remember the deceased while at the same time overcoming cemetery objections related to maintenance. Accordingly, it is an object of the present invention to provide a device for displaying items on a headstone. It is further an object of the present invention to provide such a display device which is detachably mounted to a headstone or monument by means of an appropriate mounting assembly. It is also an object of this invention to provide a headstone repository for items of personal property which may be secured by appropriate locking means.

It is yet a further object of this invention to provide a display device which may be adapted to any existing upright headstone or monument.

It is another object of this invention to provide a display device which may be adjusted to headstones/monuments of irregular shape and size.

It is also an object of this invention to provide a display device which includes a mounting assembly which creates no penetration and resulting damage to the headstone or monument.

It is yet a further object of this invention to provide a display case and mounting assembly adaptable to monuments in alternative settings of commemoration.

BRIEF DESCRIPTION OF THE DRAWINGS

The invention is described in the following in greater detail with reference to the enclosed drawings in which.

DETAILED DESCRIPTION

Figure 1:
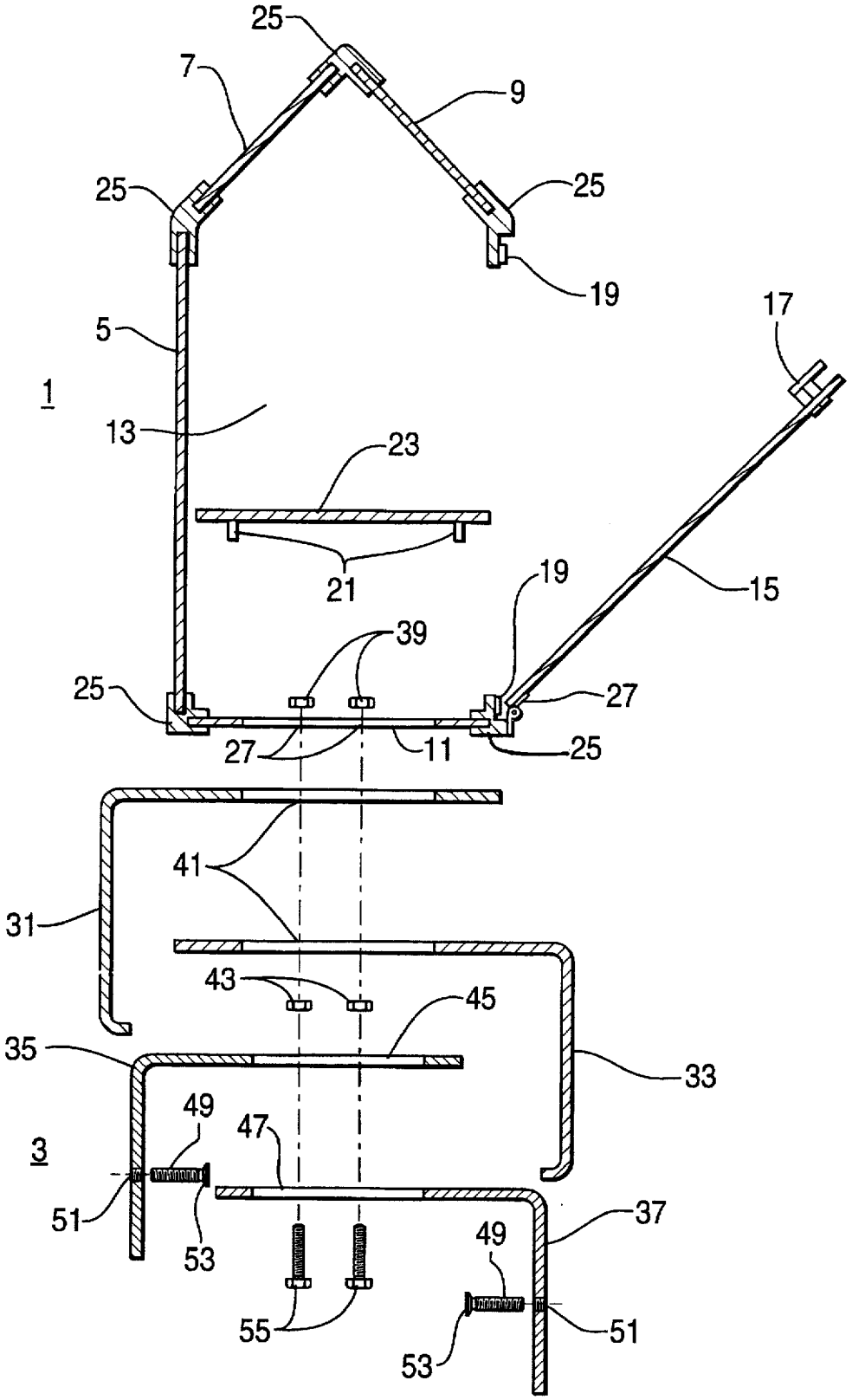
FIG. 1 is a detailed side cross-sectional view of the display device and attachment assembly.
Figure 2:
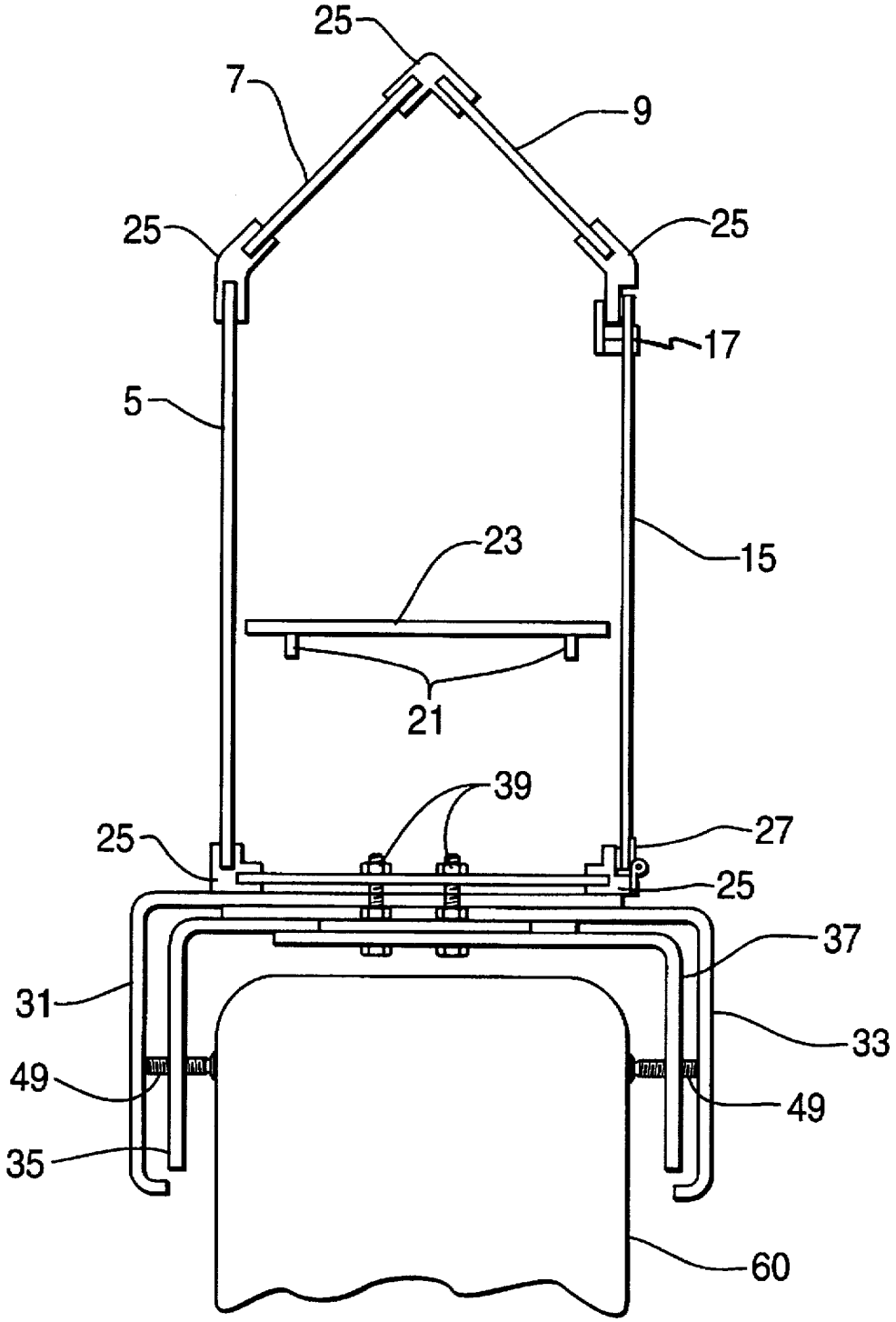
FIG. 2 is a detailed side cross-sectional, view of the display device mounted to a headstone by means of the attachment assembly.
Figure 5:
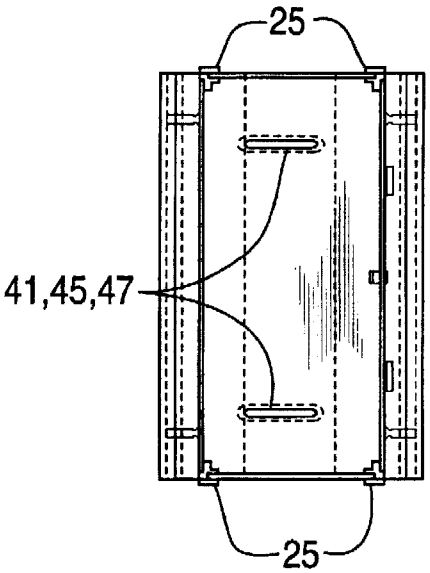
FIG. 5 is a top cross-sectional view of the display device.
Figure 4:
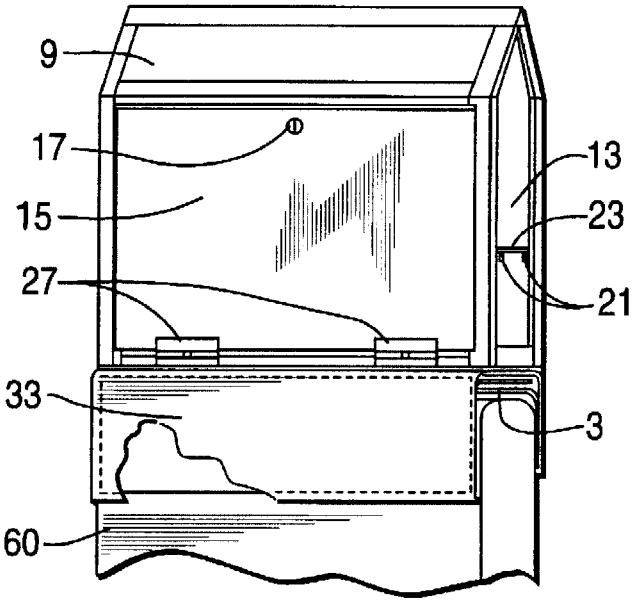
FIG. 4 is a rear perspective view of the display device attached to a headstone.
Figure 3:
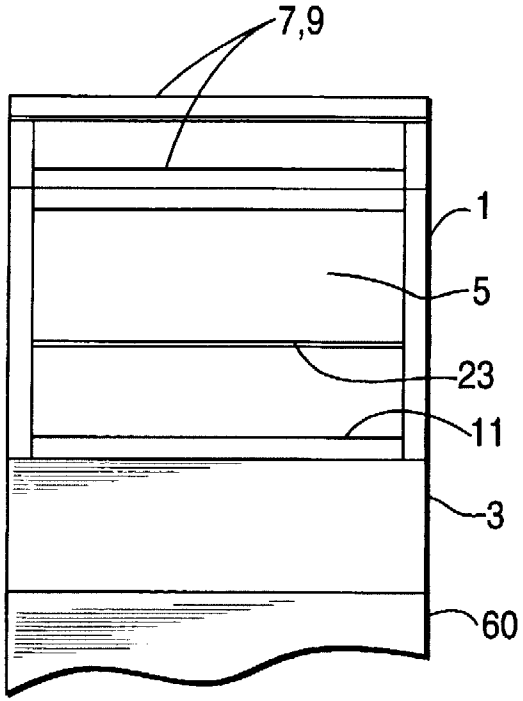
FIG. 3 is a front perspective view of the headstone and display device.

Referring to FIGS. 1 and 2, the detachable monument display case comprises display case portion 1 and detachable mounting assembly 3 for generally displaying and storing items of personalty at a gravesite or other site of commemoration. The display case 1 is attached to a headstone 60 by means of detachable mounting assembly 3 and thus achieves a non-permanent attachment to headstones/monuments of various shapes and sizes through the use of the novel adjustment feature of mounting assembly 3.

Mounting assembly 3 is constructed of a rigid rust retardent material such as plastic or stainless steel. The mounting assembly is positioned over the top portion of headstone 60 and is snugly positioned in place by means of threaded swivel bolts 49 without penetrating or marring the granite surface of the headstone. The mounting assembly 3 is generally comprised of a top section 35 and a bottom section 37 and two shroud or cover sections 31 and 33.

Top and bottom mounting assembly plates 35 and 37 are of a sufficient width so that each plate overlaps the top side of headstone 60. Each assembly plate contains a horizontal and vertical component such that the vertical component extends downwardly along the front and rear face of the upper part of the headstone 60 a length of between 5 and 20 cm. after positioning the mounting assembly in place on the headstone. Through the use of slotted holes 45 and 47 in the top and bottom assembly plates respectively, the subject invention allows for the mounting of the novel display case on headstones/monuments of varying shapes and widths.

Top mounting plate 35 and bottom plate 37 are attached by means of four threaded assembly bolts 55 which pass through slotted holes 47, 45 and which are secured by threaded assembly nuts 43 thereby firmly securing top and bottom mounting plates 35 and 37.

Mounting plates 35, 37 are next secured to the front and rear vertical sides of headstone 60 by means of threaded swivel bolts 49.

Threaded swivel bolts 49 pass through threaded holes 51 in top and bottom assembly plates 35 and 37 at which point the ends of swivel bolts 49 are anchored into the center of a swivel housing 53. The swivel housing 53 permits swivel bolts 49 to rotate within the confines of housing 53 which also functions to protect the front and rear faces of headstone 60 by distributing the forces exerted by threaded swivel bolts 49.

The detachable feature of headstone mounting assembly 3 to headstone 60 is accomplished through the adjustment of threaded swivel bolts 49 located on opposite sides of mounting assembly 3. Equal adjustment of swivel bolts 49 results in a compression of swivel housings 53 against the face of headstone 60 which creates a sufficient squeezing force to secure mounting assembly face plates 35 and 37 against the front and back faces of headstone 60.

Mounting assembly 3 will have at least four threaded assembly bolts 55 anchored firmly and protuding upwardly from the top side of face plate 35. These anchored and threaded assembly bolts 55 are also utilized to secure cover plates 31 and 33 and display case 1 to mounting plates 35 and 37.

Shroud covers 31 and 33 are provided to protect threaded swivel bolts 49. These covers are made of a rigid material such as plastic or stainless steel and are designed to fit snugly and securely over the top of mounting plate assembly 35, 37.

Each cover plate 31, 33 has at least two slotted holes 41 which are of a diameter and spacing which will permit the four assembly bolts 55 to pass through slotted holes 41. When cover plates 31 and 33 are positioned correctly over mounting plates 35, 37, the vertical faces of cover pieces 31 and 33 should be covering the vertical faces of mounting plates 35 and 37 thus protecting threaded swivel bolts 49 which are securing the mounting assembly to headstone 60.

Display case 1 is enclosed by means of front panel member 5, to side panel members 13, bottom panel member 11, roof members 7 and 9 and hingedly mounted back panel 15. These panel members are joined at their ends by means of appropriate molding sections 25. These molding sections 25 are constructed of a sturdy, rust retardant rigid material and each molding section contains two grooves running along its entire length for receiving panel sections 5, 7, 9, 11 and 13 thus defining the display case chamber. An appropriate sealing agent may be added to each molding section to function as a bonding material and sealant to permanently join the panel members and also prevent leakage from rainfall.

Back panel member 15 is hinged at its base 27 and thus functions as a door to provide access to the display case interior. Multiple hinges 27 hingedly secure back panel 15 to molding section 25. Appropriate gasketing material 19 may be applied to molding section 25 so as to create a water tight seal between hinged panel member 15 and molding section 25. A conventional locking mechanism 17 may be installed in hinged panel member 15 so as to enable access to the interior of display case 1 by means of a key.

Front, back, side panel and top members 5, 15, 13, 7 & 9 may be constructed of a transparent material thus enabling the objects of personalty placed inside display case 1 to be readily observed while display case 1 is in its closed position. Objects placed inside display case 1 may be placed on one or more shelves 23 positioned by means of shelf support members 21 which are affixed to the inside surface of side panels 13.

The top portion of display case 1 contains panels 7 and 9 joined at an angle by means of molding section 25 so as to function as a roof thus diverting water from the upper surface of the display case.

Attachment of the display case 1 to the mounting assembly 3 is achieved by positioning the display case 1 and aligning slotted holes 29 in bottom panel member 11 with threaded assembly bolts 55 which are protruding upwardly. Display case 1 will have at least two slotted holes 29 located in the bottom panel 11 for attachment to mounting assembly 3. At least four threaded assembly bolts 55 are required to secure display case 1 firmly to mounting assembly 3 which is accomplished by tightening threaded assembly nuts 39 onto assembly bolts 55. In this fashion, display case 1, cover shrouds 31 and 33 and mounting plates 35 and 37 comprise one integral unit firmly secured to headstone 60 by means of threaded bolts 49.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

For instance, the subject display case may be utilized on monuments in settings other than cemeteries, such as memorial parks.

Additionally the novel display case disclosed herein may be attached directly to a headstone or monument through appropriate bolting means without the necessity of utilizing the mounting assembly disclosed herein.

We claim:

1. In combination with a cemetery headstone, a display case comprising a bottom panel;

a front panel;

two opposite side panels;

two roof panels;

a back panel hingedly attached to said bottom panel, said panels being joined to one another by means of molding sections at respective edges thus defining a central storage chamber;

means for locking said back panel in a closed position;

one or more platform means contained within said chamber and supported therein by attachment to said side panels; and a mounting assembly comprising a top and a bottom assembly plate, bolted to a top and a bottom cover plate and threaded swivel bolts for detachably securing said display case to said headstone.

2. The display case of claim 1 wherein said front and side panels are made of a clear transparent material.

3. The display case of claim 1 wherein said roof panels are peaked to promote water runoff.

4. The display case according to claim 1 wherein said locking means comprises a conventional lock and key.

5. The display case according to claim 1 wherein said panels are joined to one another by means of sturdy rust retardent molding sections.

6. The display case of claim 1 wherein said back and roof panels are made of a clear transparent material.

7. The display case of claim 1 wherein said front and side panels are fabricated of plastic.

8. The display case of claim 1 wherein said platform means comprises a display shelf.

9. In combination with a monument, a display case comprising a bottom panel;

a front panel;

two opposite side panels;

two roof panels;

a back panel hingedly attached to said bottom panel, said panels being joined to one another by means of molding sections at respective edges thus defining a central storage chamber;

means for locking said back panel in a closed position;

one or more platform means contained within said chamber and supported therein by attachment to said side panels; and a mounting assembly comprising a top and a bottom assembly plate, bolted to a top and a bottom cover plate and threaded swivel bolts for detachably securing said display case to said monument.

* * * * *